United States Patent [19]

Spragg, Jr.

[11] 4,108,511

[45] Aug. 22, 1978

[54] MODULAR RECORD SELECTOR AND STORAGE APPARATUS

[76] Inventor: Martin Alfred Spragg, Jr., 422 Wildcroft Dr., Martinez, Calif. 94553

[21] Appl. No.: 780,462

[22] Filed: Mar. 23, 1977

[51] Int. Cl.[2] ..... A47B 81/06

[52] U.S. Cl. ..... 312/9; 312/12; 312/15; 206/387

[58] Field of Search ..... 312/8, 9, 12, 15, 17, 312/19; 206/387; 220/339; 211/40

[56] References Cited

U.S. PATENT DOCUMENTS

| | | | |
|---|---|---|---|
| 1,014,172 | 1/1912 | Pooley | 132/12 |
| 1,033,014 | 7/1912 | Holstein | 312/15 |
| 1,350,146 | 8/1920 | Fremaux | 312/15 |
| 1,366,427 | 1/1921 | Smith | 312/19 |
| 1,402,614 | 1/1922 | Hughes | 312/15 |
| 1,599,039 | 9/1926 | Carter | 312/15 |
| 2,352,710 | 7/1944 | Hart | 312/19 |
| 2,944,859 | 7/1960 | Ivanoff | 312/15 |
| 3,666,337 | 5/1972 | Sztorc | 206/387 |
| 3,779,621 | 12/1973 | Carless | 312/15 |
| 4,026,615 | 5/1977 | Tazaki et al. | 312/12 |

FOREIGN PATENT DOCUMENTS

| | | | |
|---|---|---|---|
| 671,459 | 12/1929 | France | 312/15 |
| 539,203 | 11/1931 | Fed. Rep. of Germany | 312/17 |

*Primary Examiner*—Paul R. Gilliam
*Assistant Examiner*—Victor N. Sakran
*Attorney, Agent, or Firm*—Flehr, Hohbach, Test, Albritton & Herbert

[57] ABSTRACT

A cabinet has side and rear walls, and a front opening, in which is disposed a hinged front cover, thereby forming an enclosure in which record discs are stored on edge with the upper and lower disc edges being engaged by spaced internal upper and lower cabinet grooves. A radius near the rear end of the lower groove provides a preferred position for each disc. With the hinged front cover open access is gained to a manually actuated lateral slide member which positions a selector arm at the rear edge of a record disc in a selected upper and lower groove. Further manual actuation of the selector arm in forward sliding motion on the lateral slide member urges the disc toward the front opening so that it may be manually engaged and removed from the cabinet.

17 Claims, 6 Drawing Figures

MODULAR RECORD SELECTOR AND STORAGE APPARATUS

BACKGROUND OF THE INVENTION

This invention relates to a cabinet for storing record discs, and more particularly to such a cabinet which is modular in form and may be placed in stacked or side by side relation to store a large number of record discs.

A number of record disc storage cabinets are known having vertically oriented slots for receiving record discs. Removal of the discs from the slots is generally accomplished by manual actuation of a lever system which urges the disc toward a cabinet opening. In some instances a spring member is included in the lever system to provide the energy required to move the record disc toward the cabinet opening. In each instance each record storage slot has associated therewith one lever, or lever and spring system, operating to remove the record disc positioned therein. Mechanical parts are therefore numerous and complex in shape, and mechanical assembly is consequently time consuming. Such a cabinet is seen in U.S. Pat. No. 1,267,981.

A modular record disc storage cabinet is desirable which contains structure operating to deliver record discs through a front opening therein, wherein the delivery structure is operable at each record disc storage position in the cabinet.

SUMMARY AND OBJECTS OF THE INVENTION

In general, the storage enclosure for record discs disclosed herein consists of a cabinet having two side walls, a top wall, a rear wall, and a front opening. A front cover is disposed for movement between a closed position covering the front opening and an open position remote from the front opening. An upper array of lands and grooves extends between the two side walls inside the cabinet with the upper lands and grooves running in a direction from the front to the rear of the cabinet. A lower array of lands and grooves is spaced from the upper array in facing relationship therewith within the cabinet. The lower array also extends between the two side walls with the lower lands and grooves running from the front to the rear of the cabinet so that each of the upper grooves is aligned with one of the lower grooves in over and under relationship, thereby forming an upper and lower groove pair. Means movable laterally in the cabinet is provided for positioning in alignment with ones of the upper and lower groove pairs. Disc selector means is mounted on the means movable laterally. The disc selector means is disposed for forward and rearward motion relative to the laterally movable means. Consequently, a record disc which is in one of the upper and lower groove pairs with which the means movable laterally is aligned, is urged through the front opening when the front cover is in the remote position and the selector means is moved in a forward direction.

It is an object of the present invention to provide a record disc storage cabinet constructed of a minimum number of parts having minimally complex shapes.

It is another object of the present invention to provide a record disc storage cabinet which is modular in form and may therefore be stacked or placed in fixed relation side by side.

Another object of the present invention is to provide a record disc storage cabinet which minimizes handling of the records on the record grooves.

Another object of the present invention is to provide a record disc storage cabinet which provides an index of stored records and identifies specific stored record locations.

Another object of the present invention is to provide a record disc storage cabinet which is relatively dust free when closed.

Additional objects and features of the invention will appear from the following description in which the preferred embodiment has seen set forth in detail in conjunction with the accompanying drawings.

DESCRIPTION OF THE PREFERRED EMBODIMENTS

Figure 1:
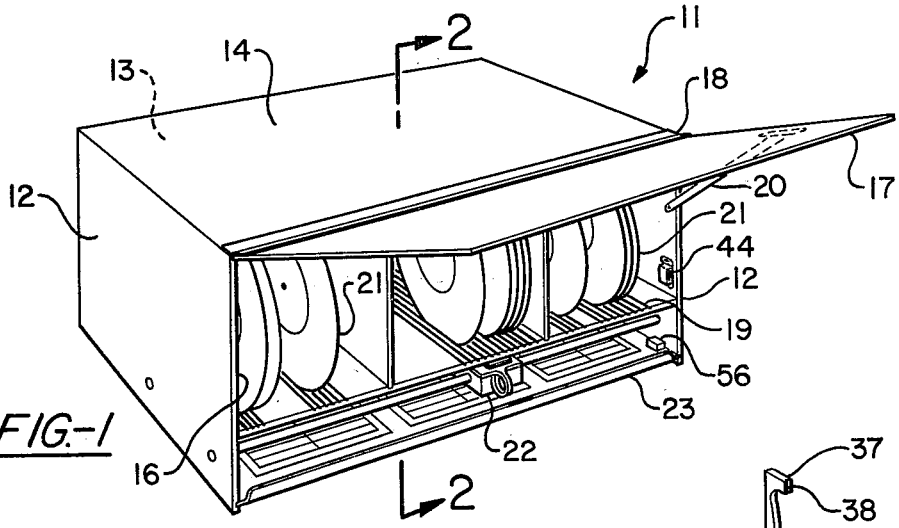
FIG. 1 is an isometric view of the disclosed record disc storage cabinet with the front cover open.

FIG. 1 shows a cabinet 11 having two end walls 12, a rear wall 13 and a top wall 14. An opening 16 is formed in the front of cabinet 11. A front cover 17 is fixed to top cover 14 by means of a piano hinge 18, in this embodiment. Front cover 17 is movable on piano hinge 18 between a position covering opening 16 and a position remote therefrom as shown in FIG. 1. A knee-type support 20 is shown attached between one side wall 12 and cover 17 which retains cover 17 in an open or remote position. A lower platform 19 is shown having a plurality of grooves therein, to be hereinafter described, each adapted to receive the edge of a record disc 21. A laterally moving carriage 22 is shown disposed beneath the lower platform 19, and a lower tray 23 is shown extending between the two side walls 12 for sliding motion in a foreward and rearward direction into and out of front opening 16. Tray 23 carries thereon indicia identifying ones of the grooves in the lower platform 19, together with space for incribing record disc titles, so that the identification of the record disc 21 in a specific groove may be sighted on tray 23.

Figure 2:
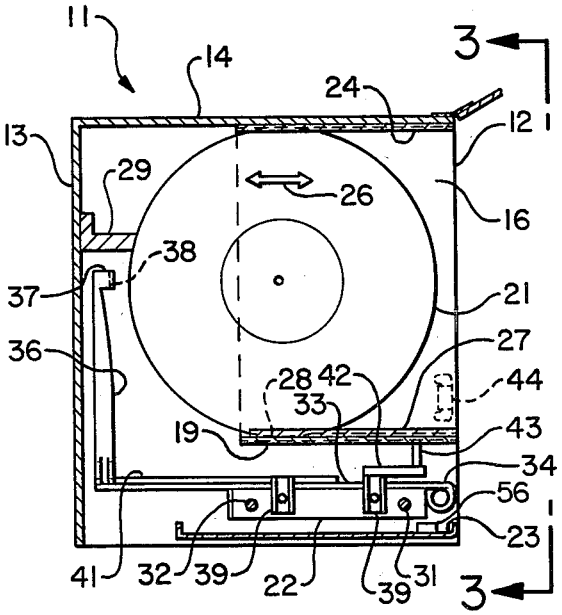
FIG. 2 is a side sectional view along the line 2—2 of FIG. 1.

The structure by which record discs 21 are stored and retained within cabinet 11 is shown in FIG. 2. An upper array of grooves and lands 24 is shown disposed between the two end walls 12 within cabinet 11, with the groove and land directions running in a forward and rearward direction within cabinet 11 as indicated by arrow 26. A lower array of lands and grooves 27 is shown disposed on lower platform 19 in facing relationship with upper lands and grooves 24 within cabinet 11. The lower array 27 extends between the two side walls 12, with the lands and grooves running forward and rearward within cabinet 11 in the direction of arrow 26. Ones of the upper grooves in the upper array 24, and ones of the lower grooves in the lower array 27, are positioned in over and under facing relationship thereby forming corresponding upper and lower groove pairs.

A record disc 21 inserted in an upper and lower groove pair may be seen to lie substantially in a vertical plane, assuming the bottom of cabinet 11 rests on a substantially horizontal surface. Grooves in the lower array 27 have a radius 28 near the rear end thereof which substantially conforms to the radius at the circumference of record disc 21. As a result, record discs 21 inserted into upper and lower groove pairs are urged by gravity to assume a preferred position within cabinet 11 in radius 28.

A rear bumper 29 is attached to the inner surface of rear wall 13, which contacts the periphery of the record disc 21 to prevent the record disc 21 from overtraveling rearwardly in cabinet 11 and thereby blocking the lateral movement of a record disc selector arm to be hereinafter described. Sliding tray 23 is shown near the bottom of cabinet 11 beneath laterally moving carriage 22, which is located beneath lower platform 19. Laterally moving carriage 22 is supported on a forward guide rod 31 and a rear guide rod 32, both of which extend between the two side walls 12. A selector slide 33 is shown carried on carriage 22 having a front handle 34 for manual engagement, and a rear upwardly extending disc engagement arm 36 with a record disc "shoe" formed at the upper end thereof. "Shoe" 37 has groove 38 formed in the front face thereof, which is adapted to engage the rear edge of a record disc 21 stored in an upper and lower groove pair and resting in radius 28. As a result, manual engagement of front handle 34 and foreward movement thereof in the direction of arrow 26, causes a stored record disc 21 to be engaged by "shoe" 37 and urged through front opening 16. Record disc 21 protrudes through opening 16 sufficiently far so that it may be grasped manually at the label portion of the record surface.

A pair of selector slide guides 39 are attached to each side of carriage 22, overlying the top surface of selector slide 33. Selector slide guides 39 are spaced from the upper surface of selector slide 33 a distance sufficient to allow manually imposed sliding motion of selector slide 33 relative to laterally moving carriage 22 in the forward and rearward direction indicated by arrow 26. A center guide strip 41 is also attached to the upper surface of selector slide 33, passing between the ends of opposing selector slide guides 39 on carriage 22. Guide strip 41 serves to assist in maintaining the foward and rearward motion of selector slide 33 in the direction of arrow 26 in spite of slight lateral forces during forward and rearward manually imposed motion. An indicator support plate 42, carrying a detent projection 43 thereon, is attached to laterally moving carriage 22. Detent projection 43 serves to indicate the lateral position of carriage 22 and therefore the lateral position of disc "shoe" 37 within cabinet 11. A magnetic latch 44 is shown attached to the inner surface of one of the two side walls 12, which operates in conjunction with a magnetic plage (not shown) attached to the inner surface of front cover 17, so that cover 17 is retained in front opening 16 when in a closed position.

Figure 4:
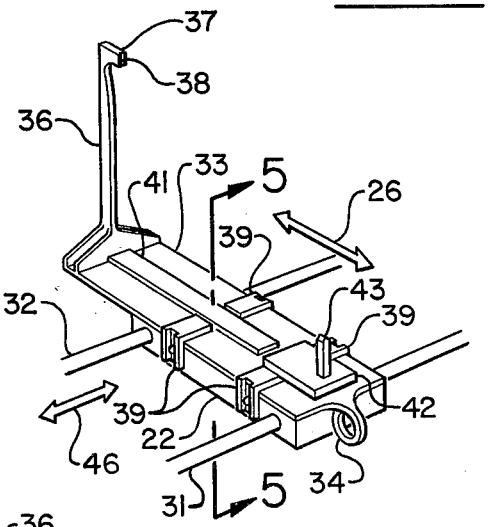
FIG. 4 is a detail view of the carriage and disc selector slide assembly indicated in FIG. 1.

The detail view of FIG. 4 shows the selector slide 33 mounted on laterally moving carriage 22. Selector slide 33 is disposed for sliding motion relative to carriage 22 in the direction of arrow 26. Selector slide guides 39 have an inverted "L" shape to overlie and retain selector slide 33 on carriage 22 as shown. Also shown is center guide strip 41 affixed to the surface of selector slide 33, together with rear upwardly extending disc engaging arm 36 and disc "shoe" 37 carrying "shoe" groove 38 for engaging the rear edges of record discs 21. Indicator support plate 42 and detent projection 43 are shown mounted to the upper suface of the front pair of selector slide guides 39, so that detent projection 43 moves laterally with carriage 22, but does not move in a forward or rearward direction with selector slide 33. Forward and rear guide rods 31 and 32 respectively are shown passing through the laterally moving carriage 22. It may be seen that carriage 22 moves on forward and rear guide rod 31 and 32 in the direction of arrow 46.

Figure 5:
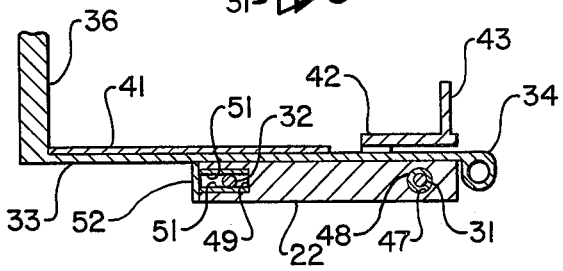
FIG. 5 is a side sectional view along the line 5—5 of FIG. 4.

The details of the construction of the laterally moving carriage 22 are shown in the sectional view of FIG. 5. Carriage 22 has a front hole 47 passing therethrough in which is disposed a bearing member 48 made of some suitable material such as Teflon TM. Bearing 48 surrounds forward guide rod 31 providing low friction resistance to lateral movement of carriage 22 thereon. A rear groove 49 is formed passing laterally through the rear portion of carriage 22 and having a flat bearing material plate 51 attached to the facing surfaces of groove 49. Rear guide rod 32 is disposed between the surfaces of flat bearing plates 51, which may also be of a relatively friction free material such as Teflon TM. A rear retaining plate 52 is fixed to the rear edge of carriage 22 for the purpose of retaining the flat bearing plate 51 within groove 49. It may be seen that rear guide rod 32 may assume a relatively wide range of positions forward and rearward between flat bearing plates 51. In this manner tight control of distances between forward and rear guide rods 31 and 32, and parallelism between the guide rods is unnecessary. Further, laterally imposed forces at front handle 34 will not cause binding forces between the guide rods and their respective bearings due to torque resulting from the lateral force being applied on front handle 34 at a distance from the central axes of the guide rods 31 and 32.

Figure 3:
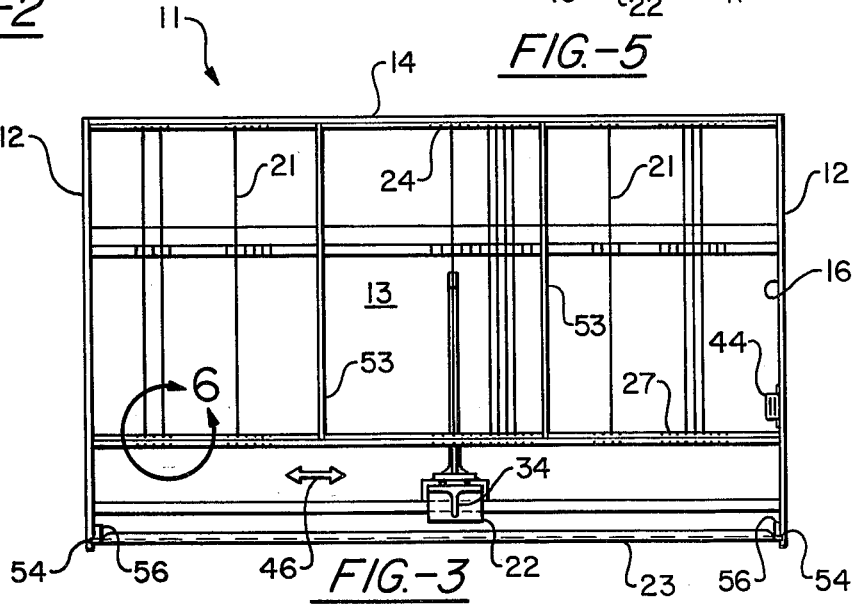
FIG. 3 is a front elevational view of the disclosed record disc storage cabinet with the front cover open.

FIG. 3 shows the record disc cabinet 11 through front opening 16. The upper array of lands and grooves 24 is shown facing and overlying the lower array of lands and grooves 27, with ones of the upper grooves overlying corresponding ones of the lower grooves to thereby form upper and lower groove pairs. Upper and lower arrays of lands and grooves 24 and 27 respectively are spaced apart sufficiently such that the bottom surfaces of a groove pair is separated by a distance slightly greater than the diameter of a record disc 21, and the adjacent land surfaces are spaced apart by a distance which is less than the diameter of a record disc 21. Consequently, record disc 21 is retained within a groove pair without probability of falling to one side or the other. A pair of vertical supporting partitions 53 are shown within cabinet 11 for the purpose of maintaining the separation between upper and lower arrays 24 and 27, so that retention of record disc 21 within groove pairs is assured across the entire width of the cabinet 11. Laterally moving carriage 22 is shown disposed for lateral motion along forward guide rod 31 in the direction of arrow 46 when forces are manually applied at front handle 34. Tray 23 is shown having its side edges disposed in facing grooves 54 on the inner surfaces of the two side walls 12. The front edge of tray 23 is turned upwardly to provide a means for grasping tray 23 to draw the tray out through the front opening 16 for visual reference when front cover 17 is in the open position. A stop block 56 is disposed above groove 54 fixed to the surfaces of the two side walls 12 to engage an upwardly turned edge at the rear of tray 23, to thereby stop tray 23 from being fully withdrawn from grooves 54.

Figure 6:
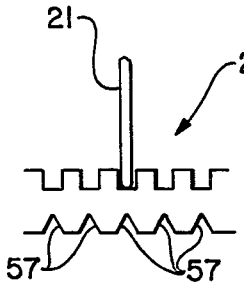
FIG. 6 is a detail view taken from the area of detail 6 in FIG. 3.

The detail of FIG. 6 shows lower array of lands and grooves 27 with a record disc 21 disposed in one of the grooves. A plurality of detents 57 are aligned one each with the grooves in the lower array 27. Detents 57 are formed to accept detent projection 43 therein. The detents are identified by any adequate means such as letters, numbers, or combinations of the same. The detent identification may also be provided adjacent to each groove in the upper and lower groove pair. The indicia on tray 23 carries corresponding identifying letters, numbers, or combinations of letters and numbers adjacent to the spaces wherein the identification of the record disc 21 stored in that upper and lower groove pair is inscribed. Detent projection 43 tends to stabilize laterally moving carriage 22 in the lateral direction of arrow 46 when it is seated in one of the plurality of detents 57. Detent projection 43 is forced laterally out of a detent 57 into the adjacent detent 57 by a sufficient lateral manual force supplied at front handle 34.

The side walls 12, rear wall 13, top wall 14 and front cover 17 of cabinet 11 may be fabricated of a "smokey" plexiglass, commonly called bronze hued plexiglass, to afford an attractive appearance to cabinet 11. Moreover, the lower surfaces of the cabinet 11 are substantially co-planar whereby one cabinet 11 may be placed atop another cabinet 11, thereby providing a stack of cabinets 11 in stable array. Rubber feet (not shown) may be fixed to the bottom surfaces of cabinet 11 for further stabilizing a stacked array of such cabinets. It is also envisioned that strips along the top of one cabinet 11 may be mated with grooves along the bottom of another cabinet 11 for stacking the cabinets and obtaining a stable stack of modular cabinets. Cabinets 11 may also be placed side by side and either left in free abutting condition, or fixed with one side wall 12 of one cabinet 11 attached to the adjacent side wall 12 of the adjacent cabinet 11. It is clear from the foregoing that the cabinets 11 are in modular form with the lower surface of one cabinet 11 substantially fitting the upper surface of another cabinet 11, and the end surfaces substantially matching so that a stable array of such cabinets may be formed end to end or stacked relation.

A record disc storage cabinet in modular form has been disclosed, which utilizes a single record dispensing mechanism, which is movable laterally along the width of the cabinet to a preselected position at which a record disc may be urged through a front opening in the cabinet by manual actuation of a front accessible handle. A minimum number of minimally complex parts are therefore utilized, which reduces expense for materials and time for assembly.

What is claimed is:

1. A storage enclosure for recording discs comprising:

a cabinet having two side walls, a rear wall, and a top wall, a front cover disposed in a front opening opposite said rear wall disposed for movement between an open position exposing the interior of said cabinet and a closed position closing said front opening, said top wall having a plurality of top grooves on the underside thereof running in a front and rear direction, a lower platform spaced from said top wall extending between said two side walls and having a plurality of bottom grooves therein facing and each being substantially aligned vertically with one of said top grooves, lateral slide means extending between said two end walls normal to said grooves, a carriage mounted on said lateral slide means for lateral movement within said cabinet normal to said grooves, a selector slide mounted on said carriage for sliding movement in said front and rear direction, a selector arm extending from said selector slide, whereby alignment with a pair of top and bottom grooves and rear to front movement of said selector slide engages said selector arm with a recording disc engaged at the top and bottom edges by said top and bottom grooves respectively, and the recording disc is urged through said front opening when said front cover is in said open position.

2. A storage cabinet as in claim 1 together with a bottom tray extending between said two end walls disposed for sliding motion through said front opening, and carrying indicia identifying top and bottom groove pairs and the recording disc contained therebetween.

3. A storage cabinet as in claim 1 together with means for selectively retaining said front cover in said open position and means for latching said front cover in said closed position.

4. A storage cabinet as in claim 1 wherein said bottom grooves have a radius formed therein near the rear end thereof, whereby the recording discs are stabilized in position when said radius engages the lower edges of the recording discs.

5. A storage cabinet as in claim 1 wherein said cabinets are modular, whereby said cabinets are stacked and joined side by side.

6. A storage cabinet as in claim 1 wherein said lower platform has a plurality of detents aligned with ones of said bottom grooves, said carriage having a projection thereon fitting said detents, whereby said carriage is indexed and retained in alignment with ones of said top and bottom groove pairs.

7. A record disc storage cabinet, comprising two side walls a rear wall a top wall, said two side walls and said top wall forming a front opening therebetween, an array of upper lands and grooves, said array extending between said two side walls and said upper lands and grooves running fron to rear, an array of lower lands and grooves, said array extending between said two side walls and said lower lands and grooves running front to rear, ones of said upper and lower grooves being aligned in over and under relationship so that record discs are engaged at the upper and lower edges thereby and are separated one from the next by at least one of said lands, lateral slide means extending between said two end walls below and normal to said array of lower lands and grooves, a carriage disposed for lateral motion on said lateral slide, said movement being normal to said grooves, a selector slide mounted on said carriage free to move bidirectionally in forward and rearward directions, a record disc arm adapted to engage the rear edge of a record disc disposed in aligned upper and lower grooves, whereby forward movement of said selector slide urges the record disc along said aligned upper and lower grooves through said front opening, and a front cover formed to move between a closed position covering said opening and an open position remote therefrom.

8. A record disc storage cabinet as in claim 7 wherein said lower grooves each have a radius near the rear end thereof formed to accept the curvature at the edge of the record disc, whereby record discs are retained by gravity within said upper and lower grooves until urged forward by said record disc arm.

9. A record disc storage cabinet as in claim 7 wherein said array of lower grooves has a plurality of detents aligned one with each of the said lower grooves, and a detent projection extending from said carriage fitting into each one of said plurality of detents, thereby retaining said carriage laterally until said detent projection is forced out of said one detent by sufficient lateral force exerted against said carriage.

10. A record disc storage cabinet as in claim 7 wherein said detents have identifying indicia thereat, together with a slide tray extending between said two end walls disposed for sliding motion into and out of the cabinet through said front opening, said slide having a substantially flat viewing surface carrying indicia matching said identifying indicia at ones of said detents, so that the record discs in specific detents are identifiable before removal.

11. A record disc storage cabinet as in claim 7 having a bottom surface, wherein said top wall substantially fits the shape of said bottom surface, and means for indexing one cabinet on top of another so that a stack of cabinets is formed.

12. A storage enclosure for record discs comprising a cabinet having two side walls, a top wall, a rear wall, and a front opening therein, a front cover movable between a closed position covering said front opening and an open position remote therefrom, an array of upper lands and grooves, said array extending between said two side walls and said upper lands and grooves running front to rear an array of lower lands and grooves spaced from said upper array, said lower array extending between said two side walls and said lower lands and grooves running front to rear, ones of said upper and lower grooves being aligned in facing over and under relationship, thereby forming upper and lower groove pairs, carriage means movable laterally in said cabinet in a direction normal to said grooves for positioning in alignment with ones of said rupper and lowr groove pairs, selector means mounted on said carriage means for forward and rearward motion relative thereto, whereby a record disc which is in said one upper and lower groove pair with which said means movable laterally is aligned, is urged through said front opening by forward motion of said selector means.

13. A storage enclosure as in claim 12 including first and second separate means for supporting said carriage means for said movement normal to said grooves.

14. A storage enclosure as in claim 13 wherein said first and second separate means includes respective first and second spaced rods extending between said side walls within said cabinet, normal to said groove and wherein said carriage means is slidably mounted on said rods.

15. A storage enclosure as in claim 14 wherein said carriage means includes two bearing openings through which said rods extend, one of said openings conforming in shape to the outer periphery of its associated rod while said other opening is substantially larger than its rod, in the direction normal to said rod.

16. A storage enclosure as in claim 1 wherein said lateral slide means includes separate spaced rods extending between said side walls and normal to said grooves and wherein said carriage is slidably mounted on said rods, said carriage including two bearing openings through which said rods extend, one of said openings conforming in shape to the outer periphery of its associated rod while said other opening is substantially larger than its rod, in the direction normal to said rod.

17. A record disc storage cabinet as in claim 7 wherein said lateral slide means includes separate spaced rods extending between said side walls and normal to said grooves and wherein said carriage is slidably mounted on said rods, said carriage including two bearing openings through which said rods extend, one of said openings conforming in shape to the outer periphery of its associated rod while said other opening is substantially larger than its rod, in the direction normal to said rod.

* * * * *